US005186251A

United States Patent [19]

Joshi

[11] Patent Number: 5,186,251

[45] Date of Patent: Feb. 16, 1993

[54] ROLL FORMED HEAT EXCHANGER TUBING WITH DOUBLE ROW FLOW PASSES

[75] Inventor: Shrikant M. Joshi, Cambridge, Mass.

[73] Assignee: General Motors Corporation, Detroit, Mich.

[21] Appl. No.: 891,083

[22] Filed: Jun. 1, 1992

[51] Int. Cl.[5] ..... F28F 1/02; F16L 9/04; B21D 53/02

[52] U.S. Cl. ..... 165/177; 165/183; 165/906; 29/890.053; 138/170; 138/171

[58] Field of Search ..... 165/177, 183, 906; 29/890.053; 138/170, 171; 72/379.2

[56] References Cited

U.S. PATENT DOCUMENTS 2,554,185 5/1951 Giegerich ..... 165/175
2,655,181 10/1953 Cooper ..... 165/152
4,024,619 5/1977 Jonason ..... 29/890.053

*Primary Examiner*—John Rivell
*Assistant Examiner*—L. R. Leo
*Attorney, Agent, or Firm*—Patrick M. Griffin

[57] ABSTRACT

Heat exchanger with double row tubes with each tube being substantially identical and made by a sequence of roll forming operations from a single piece blank so that it has a centralized vertical connector web of the thickness of the blank connecting and supporting opposite side walls of the tubes to separate each tube into separate flow passes for augmenting tube burst strength from high internal pressures. Also, the vertical connector web effectively eliminates tube crushing from compression loads exerted onto a core of tubes and corrugated air centers by retainer bands used to hold these components together for their subsequent brazing together in a high temperature oven to form a core. With these tubes employed, heat exchanger efficiency is improved since the apices of the air centers have extensive direct contact with the flat sides of the roll formed tubes thoughout their widths. The tubes of this invention are formed with effective and efficient usage of all material of the blank and have continuous and even peripheries for improved brazing to header plates or end tanks facilitating the manufacture of high capacity heat exchangers with reduced weight. After being brazed and employed in a heat exchanger, heat energy is transferred by conduction from the heat exchanger fluid to the tubes and then directly to the air centers.

6 Claims, 2 Drawing Sheets

FIG 1
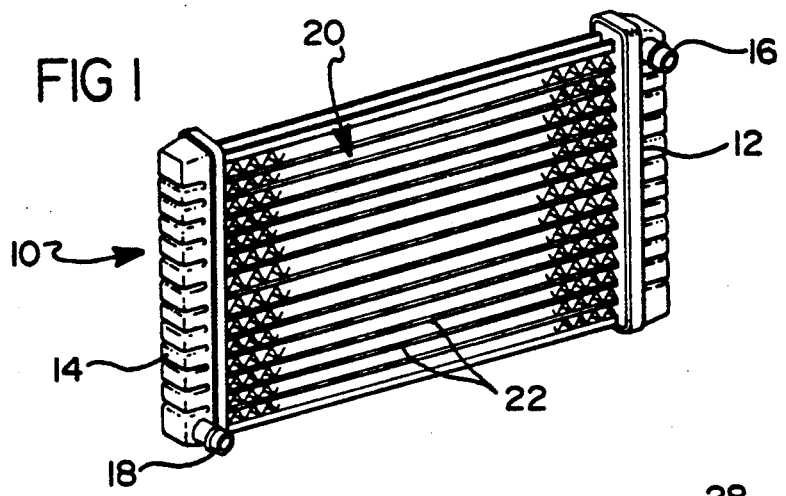
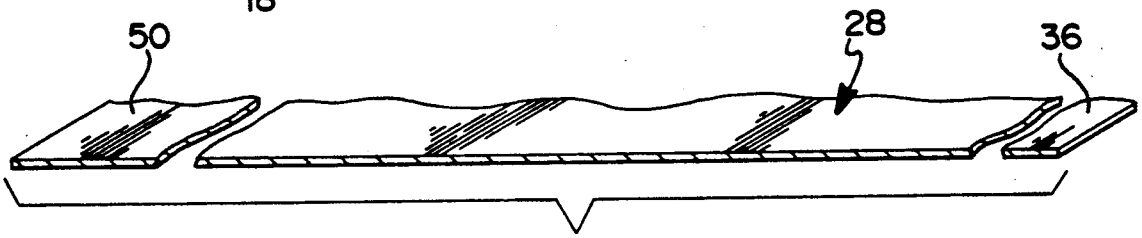
FIG 2
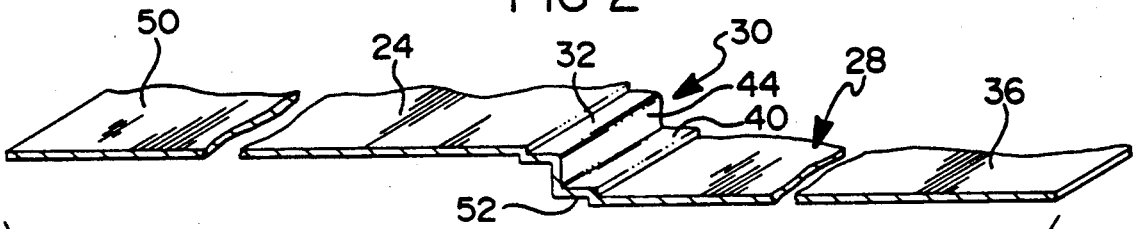
FIG 3
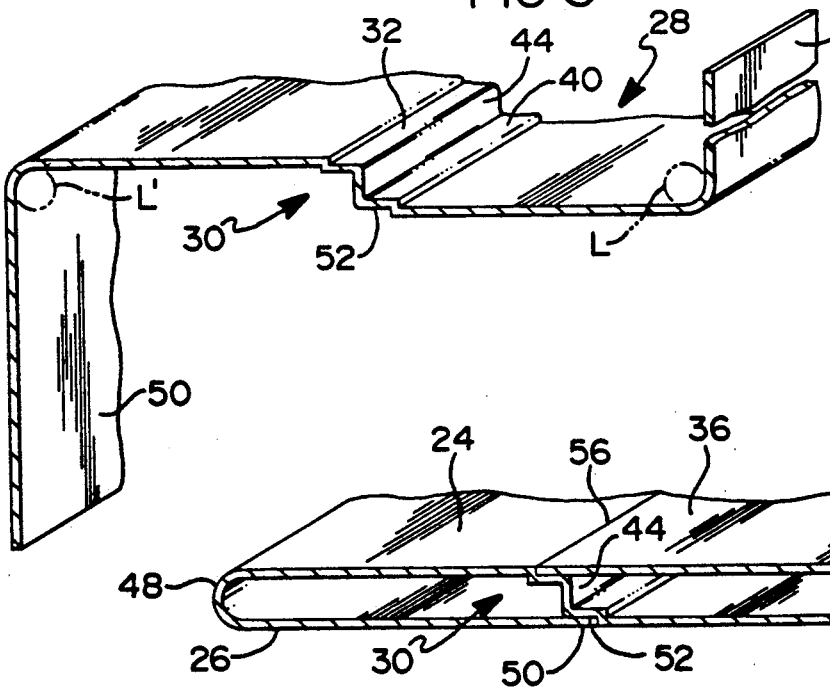
FIG 4
FIG 5
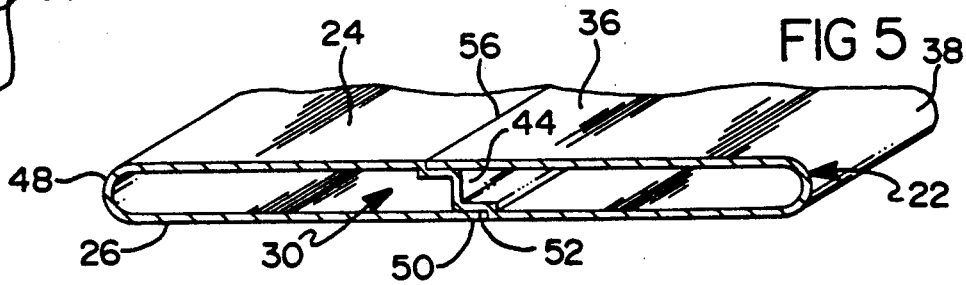

ROLL FORMED HEAT EXCHANGER TUBING WITH DOUBLE ROW FLOW PASSES

TECHNICAL FIELD

This invention relates to heat exchangers and more particularly to new and improved heat exchanger tubing with multiple row flow passes and to a new and improved method of making heat exchanger tubing.

BACKGROUND OF THE INVENTION

Prior to the present invention various tubing arrangements have been provided for radiators and other heat exchangers including unitized tubes with discrete double row fluid passages therethrough for high performance application to take the place of heat exchangers having multiple row of individual tubes.

BACKGROUND ART

In U.S. Pat. No. 2,655,181, for example, a heat exchanger tube is formed by a tube mill which progressively bends sheet metal stock to form tubes with each having separate passages formed by an inclined multiwall central web. This web is made by bending end portions of the stock or blank internally of the tube so that an inclined multi-part divider web is formed between flow passages ellipsoidal in cross section. The tubes are then externally fluxed and a coat of solder is applied to cover their peripheries. These tubes are then sandwiched with air centers therebetween by compressively loaded with straps and then the strapped assembly is placed the in an oven at a high temperature so that the solder liquifies and forms a heat transfer joint as the sides of the ellipsoidal tubes are flattened.

The present invention is of the general category of the above-identified U.S. patent, but further provides tubes which are roll formed and are initially made with flat sides so that improved air center contact with the sides of the tubes is obtained after fluxing and coating, and particularly, without reliance on compressive loads applied before brazing in the oven. Furthermore, this invention has a vertical single wall center divider web that provides improved strength and resistance to collapse during brazing. With this invention, substantially less blank material is required resulting in substantial savings in material costs, as well as weight of the tubes and the heat exchanger made therewith. With a reduced thickness in the divider web, heat transfer is improved since there is reduced metal and heat sinking in the web and there is improved contact with the air centers for heat transfer.

These and other features, objects and advantages of this invention will become more apparent from the following detailed description and drawings in which:

BRIEF DESCRIPTION OF THE DRAWINGS

FIG. 1 is a pictorial view of a radiator for circulating engine coolant therethrough utilizing the tubing of this invention;

FIG. 2 is a pictorial view of a portion of a metallic blank of predetermined dimensions used to make the double row tubing of this invention;

FIG. 3 is a pictorial view of the blank showing the initial formation the central support and divider web of the double row tubing of this invention;

FIG. 4 is a pictorial view of the blank of FIG. 4 being rolled formed to make the sides of the double row tubing of this invention;

FIG. 5 is a pictorial view of the blank of FIG. 5 being further roll formed so that opposite ends of the blank are seated on the central support or web thereof;

DETAILED DESCRIPTION OF THE DRAWINGS

Figure 6:
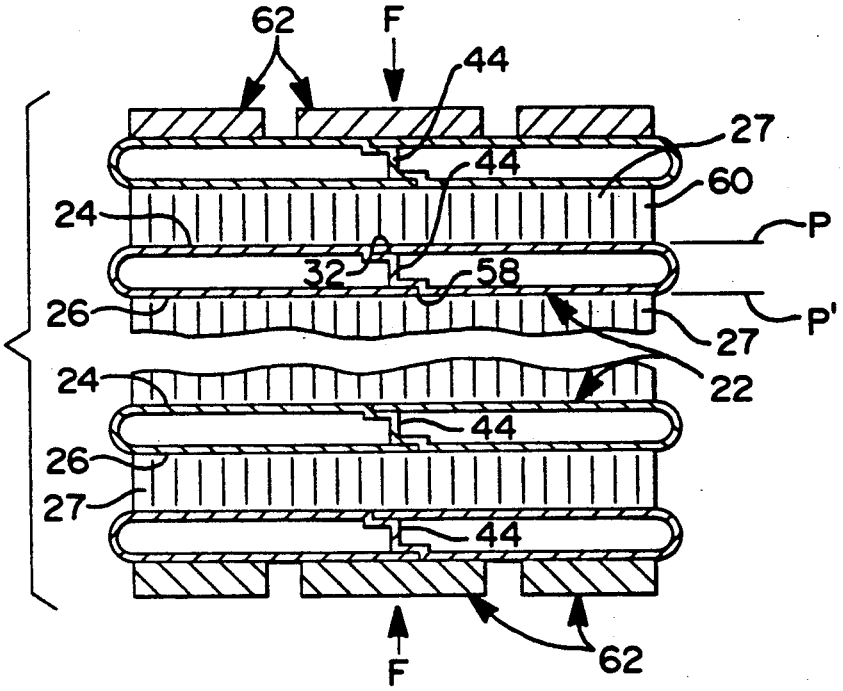
FIG. 6 is a cross-sectional view of the double row tubing of this invention and with air centers therebetween under compressive load for brazing in an oven.

Turning now in greater detail to the drawings, there is shown in FIG. 1 a heat exchanger in the form of a radiator 10 that may be employed in a vehicle to provide cooling for the vehicle engine, as well as other components requiring transfer of heat energy. The radiator has side tanks 12, 14 that respectively have inlet and outlet spouts 16 and 18 that are adapted to be coupled by hoses to the water jacket of the engine. The radiator 10 has a core 20 formed from a plurality of elongated tubes 22 generally oval in shape cross section with flattened upper and lower sides 24 and 26. In addition to the tubes 22, the core has corrugated and louvered air centers 27 sandwiched between the tubes so their apices contact the flat sides of the tubes for increasing heat transfer efficiency as cooling air flows through the air centers past the tubes.

Each of the tubes is a double row, or double pass tube, formed from an elongated rectangular blank 28, shown best in FIG. 2, of copper, aluminum or other suitable material.

In the preferred embodiment of the invention, the double row tube is sequentially roll formed from the flat blank 28 of FIG. 2 into the oval flat sided tube 22 of FIG. 5. As shown in FIG. 3, an intermediate portion of the blank is offset with a stepped portion 30 so that opposite end portions of the blank form outstretched arms that extend in opposite directions and in parallel planes. At predetermined locations L and L' intermediate the extent of each arm, the ends thereof are turned in a vertical direction up and down as shown in FIG. 4. After the step of FIG. 4, the opposite end portion are reversely turned so that their squared ends rest on the steps provided in the blank, as shown by FIG. 5, to complete the roll forming of the tube 22.

More particularly, the intermediate offset 30 has an uppermost step 32 offset from a first plane P containing the upper side wall of the tube by an amount substantially equal to that plane. The top of the upper step 32 forms a support for the squared leading edge or end 36 of the blank 28. Referring to FIG. 5 and from this uppermost step 32, the wall of the tube extends in a first direction and in the first plane P to a rounded forward edge 38 of the tube. The forward edge is reversely curved to lead into a second plane P' containing the lower side of the tube. At the termination of the reverse curvature of the rounded edge, the tubing wall extends in a second direction and in the second plane P' until it reaches onto the bottom of a lower step 40. The bottom surface of the lower step 40 is offset from the second plane P' by an amount substantially equal to the second plane. From the lower step 40 the intermediate offset 30 has a vertical riser or web 44 leading into the forward extent of the first step, as illustrated in FIGS. 3, 4, 5 and 6.

From the top of the first step, the tube wall extends in the first plane P but in the second direction to a rounded back edge 48 that is reversely curved to turn back into the second plane P'. The wall then extends in the second plane to a squared terminal end 50 which seats on the flat bottom surface 52 of the lower step. The end of the blank are to fitted as closely as possible on their respective support steps to form small clearance at their upper and lower seams 56 and 58. With this small clearance only minimized amounts brazing materials are required to make a high quality seal with optimized uniformity and smoothness.

The improved flat support for the end of the blanks provided by the upper and lower steps of this invention allow maximized contact with the apices of the corrugated air centers 27 that are sandwiched between the flat sides of adjacent tubes in a multi-tube heat exchanger before brazing in an oven.

FIG. 6 diagrammatically illustrates the tubes and air centers after they have been fluxed and coated with a suitable brazing material, stacked into a core and strapped together by straps 62 and placed into an oven. The straps compressively load the core but the vertical riser or web 44 in each tube effectively bears this load which increases during brazing as oven temperature increases and the core expands opposing the constricting force of the straps. Accordingly, the straight forward overlapped support of the ends of the blank and the improved centralized vertical support of the tubes provides for optimized successful brazing of cores with reduced rejection from collapsed tubes or poor brazing of the air centers to the adjacent sides of the tubes. The web further will not act as a heat sink and provides good transfer of heat to the outer walls of the tube and air centers by conduction.

The smooth and continuous tube profile of this invention will result in a strong and leak free joint between the tube and header plates of the side tank or other header plates with which the core is to be used. Furthermore, the middle vertical riser or web 44 is an effective strengthening web has only one layer providing a lighter and more economical design capable of bearing high crush loads as compared with prior one piece double row tube constructions such as exemplified in FIGS. 7 and 8.

In addition to providing optimized resistance to compression loads during brazing the internal web or riser 44 improves tube strength in resisting internal pressure form heat exchanger fluids during operation of the heat exchanger. With this straight forward design there are no internal folds so that the manufacture of the tubes by a continuous high speed roll forming operation is enhanced utilizing a tube mill.

Figure 7:
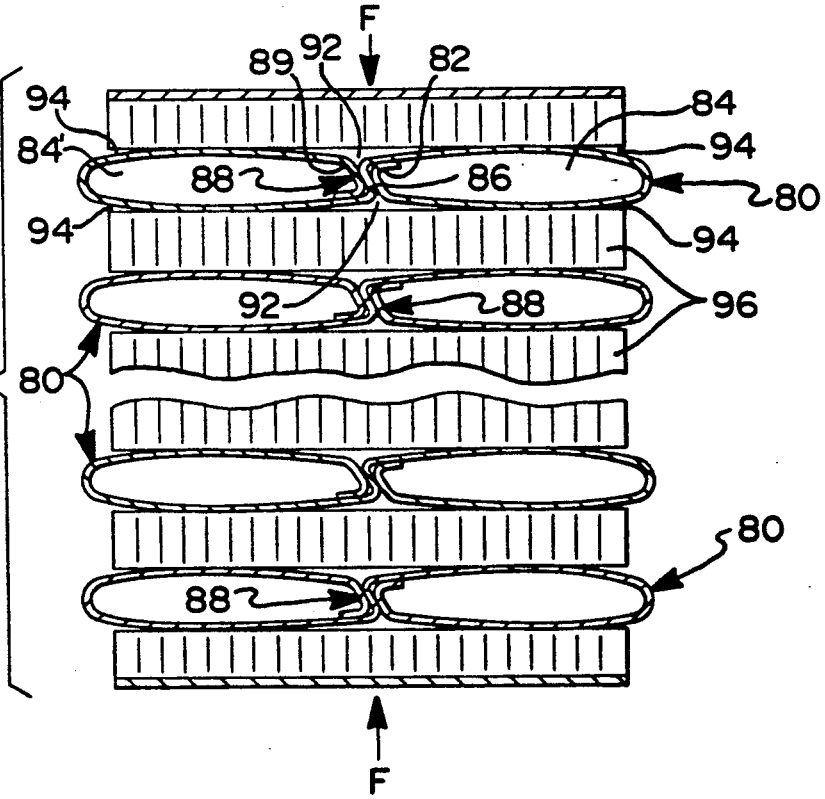
FIG 7 PRIOR ART
FIG. 7 is a cross-sectional view of prior art tubing and air centers sandwiched therebetween being compressively loaded for brazed in an oven.

The prior construction as diagrammatically illustrated in FIG. 7 shows double row tube 80 roll formed from a single blank with each side of the tube being generally elliptical in cross section. The tube is rolled from a starting end, such as end 82. The first row 84 of the double row is made by rolling the material of the blank around the outside of the starting end 82 to form the center middle section 86 of the compound and thickened intermediate web 88. From the bottom of this middle section 86, the second row 84' is elliptically rolled to the internal terminal end 89 which fits against the central section to form the second row of the double row tube 80.

Figure 8:
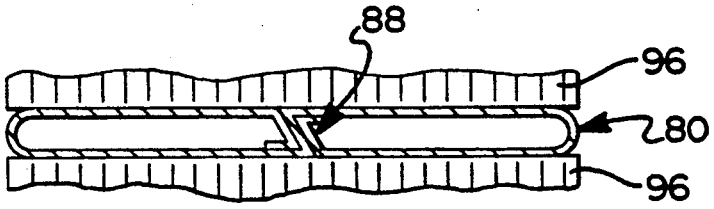
FIG 8 PRIOR ART
FIG. 8 shows a portion of the tubing and air centers of FIG. 7 after brazing and removal from the oven.

As will be observed from FIG. 7, void areas 92 and 94 appear at the center and end portions of the double row tubes as they are sandwiched with corrugated and louvered air centers 96. To provide for improved air center and tube contact, the core is compressively loaded as illustrated by compression force F in FIG. 7 and placed in a brazing oven. The compression load squeezes the rows to flatten out the sides and the brazing material ideally eliminates or reduces the void areas to effect flattened contact surfaces between the air centers and the sides of the tubes, as shown in FIG. 8. While these prior tubes are effective, they require more blank material as compared to the present invention.

The compound central web 88 is inclined and thereby subject to bending and tube collapse under high loads that may be experienced during brazing. Furthermore, this inclined middle web 88 is weaker in resisting high internal pressures of the coolant as it courses through the tubes 80. Additionally, the compound multi internal folds of the prior construction are difficult to control tube form and shape during roll forming which results in wide tolerance range.

In contrast to the prior art and in general summary, the present invention provides a smooth and continuous tube profile that will result in a strong and leakfree tube to header joint. This profile also ensures full contact between the tubes and air center fins, improved heat conduction path and a higher heat transfer efficiency for the unit. Also, the middle strengthening web has only one layer, which makes the tube of this invention lighter and less expensive. The vertical middle web further makes this design stronger in resisting compression during brazing operation. It also makes it stronger in resisting internal heat exchanger fluid pressure. The straightforward design of this invention has no internal folds so that it can be easily manufactured by continuous high speed rollforming operation on a tube mill.

With this invention, other modification can be made employing the principles and teaching of the disclosure herein. It is therefore the intent of this specification to illustrate preferred embodiments of the invention, and the invention to be limited to the scope of the following claims.

I claim:

1. A method of making a tube for a heat exchanger having dual fluid flow passages discrete from one another and having substantially planar sides throughout the length and width of said tube comprising the steps of:

providing a strip of flat metal stock of predetermined thickness, length and width, offsetting first and second portions of said strip of stock from one another with an intermediate connector portion which includes a web formed so that said first and second portions lie in first and second planes generally parallel to one another, forming a first step in said intermediate connector portion so that a top surface thereof is made which is offset from a top surface of said first portion by a dimension approximating the thickness of said strip of metal stock, forming a second step in said stepped intermediate connector portion so that a bottom surface thereof is offset from a bottom surface of said second portion by a dimension approximating the thickness of said strip of said metal stock, bending said second portion so that it reversely curves and follows a substantially straight path until the end thereof fits onto the first step, bending the first portion so that an end portion thereof is reversely curved to follow a substantially straight path until the end thereof fits onto the bottom surface of said second step to thereby complete the formation of said tube.

2. A method of making a flat sided tube for a heat exchanger having dual fluid flow passages discrete from one another and having substantially planar sides throughout the length and width of said tube comprising the step of:

providing a strip of flat metal stock of predetermined thickness, length and width, offsetting first and second portions of said strip of stock from one another with an intermediate portion which includes a vertical web formed so that said first and second portions lie in first and second planes and substantially parallel to one another, forming a first step in said intermediate portion so that a top surface therefor is offset from a top surface of said first portion by a dimension approximating the thickness of said strip, forming a second step in said intermediate portion so that a bottom surface of said second step is offset from a bottom surface of said second portion by a distance approximating the thickness of said strip, bending said second portion to form a reversely curved and rounded forward edge and so that said second portion follows a substantially straight path until the end thereof fits onto the first step, bending said first portion to form a rounded reversely curved and rounded rear edge so that said first portion follows a substantially straight path until the end thereof fits onto the bottom surface of second step.

3. A method of making a flat sided tube for a heat exchanger having dual passages discrete from one another and having substantially planar sides throughout the length and width of said tube comprising the step of:

providing a first strip of flat metal stock of predetermined thickness, length and width, offsetting first and second portions of said first strip of stock from one another with a stepped intermediate portion which includes a vertical web portion formed so that said first and second portions lie in different planes, forming a first step in said stepped intermediate portion so that a top surface thereof is offset from a top surface of said first portion by a dimension approximating the thickness of said strip and forming a second step in said stepped intermediate portion so that a bottom surface of said second step is offset from a bottom surface of said second portion by a distance approximating the thickness of said strip, bending said second portion to form a reversely curved edge of said tube and so that said second portion follows a substantially straight path until a terminal end thereof fits onto the first step and abuts the first portion, bending the first portion to form a reversely curved and opposite edge of said tube and so that said first portion follows a substantially straight path until a terminal end thereof fits onto the bottom surface of said second step and abuts the second portion to thereby complete the formation of said tube.

4. A one piece dual passage tube for transmitting heat exchanger fluid therethrough comprising an intermediate stepped portion defined by a first step having a flattened tread-like support surface, said tube being defined by a wall of a predetermined thickness having a leading end portion supported on said support surface and extending in a first plane and in a first direction to a curved edge, said tube being reversely curved at said curved edge so that the wall therefor extends in a second plane parallel to said first plane and in a second direction opposite to said first direction until intersection with a second step of said stepped portion, said second step of said stepped portion having a tread-like support, said second step having a lower surface which is offset from said second plane by a measure approaching the thickness of said wall of said tube, said intermediate stepped portion having a vertical web that connects to the forward extent of said first step, said wall of said tube extending from an upper extremity of said first step in said first plane, but in said second direction to a second curved edge, said wall there being reversely curved to extend to said second plane and leading therefrom to a bottom surface of said second step for support thereon to complete the tube with the stepped intermediate portion separating the interior of said tube into discrete fluid flow passages.

5. A one piece dual passage tube with a wall of predetermined thickness for transmitting heat exchanger fluid therethrough comprising a stepped portion defined by first and second steps each having a flattened tread-like support surface, said tube having a first section with a leading end portion supported on said support surface of said first step and extending in a first plane and in a first direction to a first curved edge, said wall of said tube being reversely curved to a second plane parallel to said first plane and continuing therefrom in said second plane and in a second direction opposite to said first direction until it intersects with said second step of said stepped portion, said tread-like support surface of said second step being offset from said second plane by a measure approximating a thickness of said wall of said tube, said stepped portion having a vertical web that connects to the forward extent of said first step, said wall of said tube extending from the upper extremity of said first step in said first plane but in said second direction to a second rounded edge, said wall there being reversely curved to lead into said second plane and extending therefrom to the support surface of said second step for support thereon to complete the tube with the stepped portion operating the interior of said tube into discrete fluid flow passages.

6. A one piece dual passage tube with a wall of predetermined thickness for transmitting heat exchanger fluid therethrough in separate passages comprising a stepped portion defined by first and second stepped portions each having a flattened tread-like support surface, a web joining said tread-like support surface to one another, said tube having a first section having a leading end portion supported on said support surface of said first step and extending in a first plane and in a first direction to a first curved edge, said wall of said tube being reversely curved to extend to a second plane parallel to said first plane and then continuing in said second plane and in a second direction opposite to said first direction until intersection with said second stepped portion, said tread-like support surface of said second stepped portion being offset from said second plane by a measure approximating the thickness of said wall of said tube, said web being vertical to connect to the forward extent of said first step, said wall of said tube extending from an upper extremity of said first stepped portion in said first plane but in said second direction to a second rounded edge, said wall there being reversely curved to lead into said second plane and extending therefrom to the support surface of said second step for support thereon to complete the tube with the stepped intermediate portion separating the interior of said tube into discrete fluid flow passages.

* * * * *